US005946776A

United States Patent [19]

Bourquin

[11] Patent Number: 5,946,776

[45] Date of Patent: Sep. 7, 1999

[54] WRISTLET CLASP

[75] Inventor: Aurèle Bourquin, Les Genevez, Switzerland

[73] Assignee: ProtAurec Sarl, Les Genevez, Switzerland

[21] Appl. No.: 09/140,424

[22] Filed: Aug. 26, 1998

[30] Foreign Application Priority Data

Sep. 3, 1997 [EP] European Pat. Off. ..... 97115244

[51] Int. Cl.[6] ..... A44B 11/00; A44C 5/00

[52] U.S. Cl. ..... 24/71 J; 24/68 J; 24/70 J; 24/265 WS

[58] Field of Search ..... 24/71 J, 70 J, 24/265 WS, 68 J, 583

[56] References Cited

U.S. PATENT DOCUMENTS 1,700,084 1/1929 Schwarz .
1,756,769 4/1930 Tost .
2,110,936 3/1938 Myrberg ..... 24/71 J
3,478,537 11/1969 Golberine et al. ..... 24/265 WS
3,521,331 7/1970 Gay ..... 24/265 WS
4,424,611 1/1984 Mori ..... 24/71 J
5,771,543 6/1998 Froidevaux et al. ..... 24/71 J

*Primary Examiner*—Victor N. Sakran
*Attorney, Agent, or Firm*—Griffin, Butler, Whisenhunt & Szipl, LLP

[57] ABSTRACT

Wristlet clasp including first and second elements (1, 2), respectively mechanically connected to strands (5, 6) of a wristlet. A third element (3) mechanically connects in a hinged manner the first and second elements (1, 2). A cap (4) is rigidly and removably fixed to the first element (1). This cap includes two wings. The first element (1) is pierced by two transverse holes (15, 16) in which two pins or screws (35, 36) are engaged. One of these two transverse holes (35) is covered by the wings of the cap. The adjustment of the length of the wristlet is effected by connecting the first element and the third element to each other either via the first pin or screw (35), or by the second pin or screw (36).

10 Claims, 7 Drawing Sheets

WRISTLET CLASP

The present invention relates to a wristlet clasp. It concerns more particularly a clasp of this type including a first element and a second element intended respectively to be connected to a first and a second strand of a wristlet and a third element which mechanically connects, in a hinged manner, the first and second elements, this clasp including means for adjusting the length of the wristlet so as to fit it to a wearer's arm and which include a pin engaged in at least one hole among a plurality of transverse holes, made in the first element.

A clasp of this type is disclosed and shown in Patent No. DGM 9 401 541. It also includes three elements. The first element is connected to one of the strands of a wristlet. The second element is mechanically connected in a hinged manner to the second strand of the wristlet and the third element connects the first and second elements in a hinged manner to allow the clasp to be opened and closed.

The first element has the form of a cap with an upper face which covers the other element of the clasp and two wings extending longitudinally on the sides of the clasps and pierced by a plurality of transverse holes. This cap is probably made by stamping a stainless steel sheet. The end hole allows assembly of the cap with the first strand of the wristlet. The other transverse holes are intended to accommodate another pin which is also engaged in a transverse hole of the third element, the selection of the hole defining the length of the wristlet.

This solution allows assembly of two wristlet strands and adjustment of the length of said wristlet to the size of a wearer's arm. It is to be noted, however, that in such a configuration, the pins engaged in the transverse holes of the first element exert traction on their walls which causes wear and can lead to ovalisation of said holes, or even to the pin being released. This defect considerably reduces the lifespan of clasps of this type. This is due in particular to the fact that firstly the wings of the first element are not very thick in order to be able to be stamped and secondly the stresses that a wristlet and in particular its clasp must undergo are considerable.

In order to improve the aforementioned clasp, the walls of the wings of the first element would have to be thicker. This would result either in the last link having a very different structure to the others, which would substantially increase its cost, or the walls of the wings of the cap extending well beyond the width of the links. In this latter case, the clasp is enlarged, which is unattractive and increases the risk of it catching. Moreover, the cap can no longer be made by stamping.

An object of the present invention is to overcome the drawbacks of the aforementioned prior art.

In the previously described solution, the wings of the cap are each pierced by a row of holes. The aesthetic appearance of the clasp is thereby affected.

Another object of the present invention is to improve the aesthetic appearance of the clasp.

These objects are achieved as a result of the features of the claim 1.

In this configuration, the cap is no longer subjected to the stresses that the wristlet undergoes. Conversely, it is the first element which is subjected to these stresses. Moreover, the first element can be made in a solid structure with the holes guaranteeing maximum engagement of the pin, the length of these holes being at least equal to their diameter.

The invention will be better understood upon reading the following description which is made with reference to the annexed drawing, and given by way of non limiting example, in which.

The clasp shown in FIGS. 1 to 4 describes a first embodiment of the invention. It includes three elements, referenced 1 to 3, hinged in relation to each other, a cap 4 and two wristlet strands 5 and 6.

Figure 4:
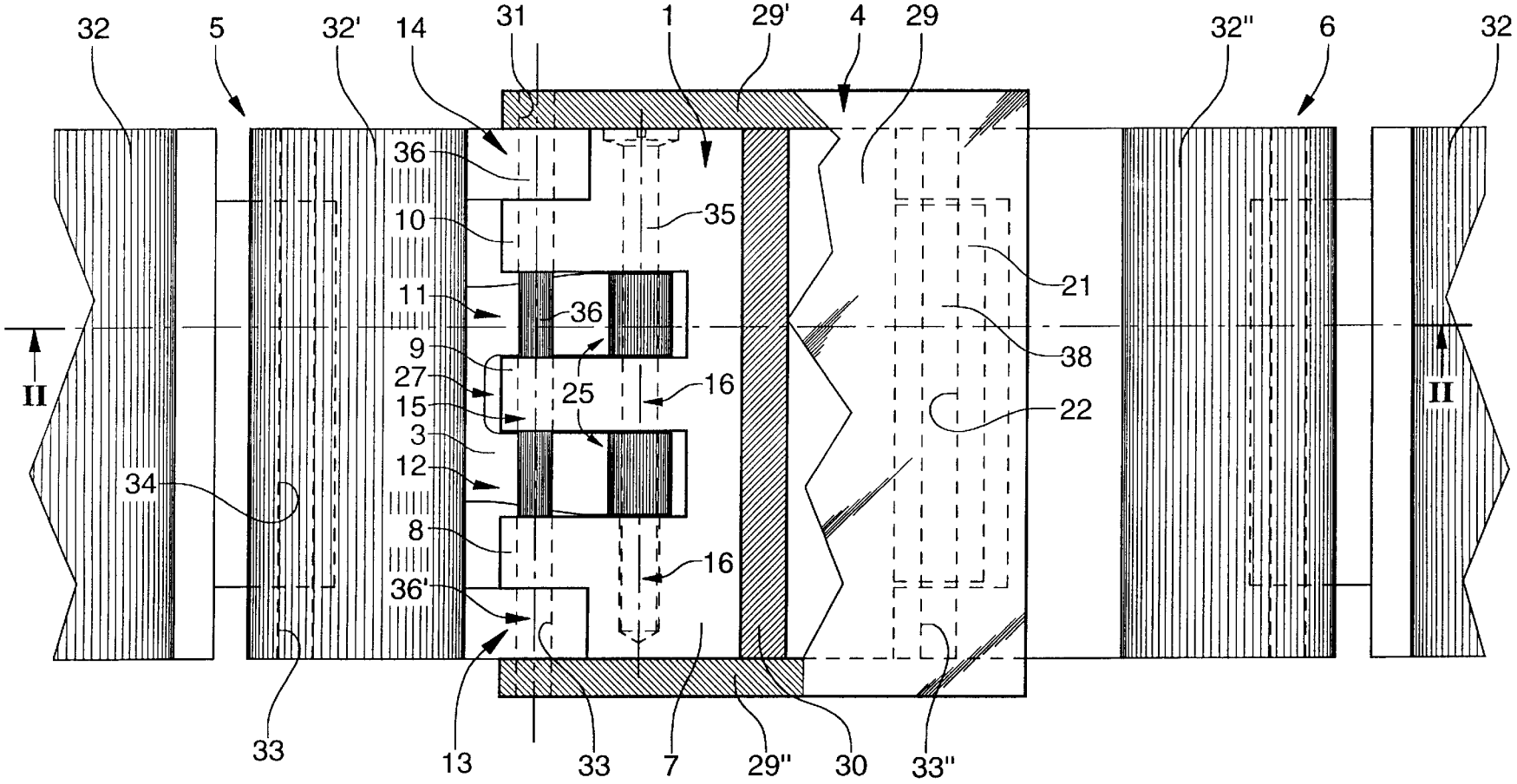
FIG. 4 is a top plane view, partially torn away, of the clasp according to the configuration shown in FIG. 1.

The first element 1 includes a body 7 and three longitudinal fingers 8, 9 and 10, defining between them notches 11 and 12 (FIG. 4). Fingers 8 and 10 have a notch on their outer sides, defining steps 13 and 14. Fingers 8, 9 and 10 are pierced by two transverse holes 15 and 16, which are parallel to each other. On the opposite side to the fingers, body 7 includes a shoulder 7'.

The second element 2 is formed of an arm 17 including two heads 18 and 19 occupying the two ends of said arm 17. Head 18 has a bulge portion pierced by a transverse hole, while head 19 bears a welded tube 21 pierced by a hole 22 and extending transversely.

The third element is formed of an arm 23 including two heads 24 and 25 occupying the two ends of arm 23. Head 24 has a bulge portion pierced by a hole 26. It includes in a known manner two transverse portions placed on either side of head 18. Head 25 is configured to be inserted into notches 11 and 12. It has a bulge portion pierced by a transverse hole 28 and includes a longitudinal median slit 27.

Cap 4 includes a first portion 29 with a U shaped transverse section whose median zone covers the first element and whose wings 29' and 29" extend on either side of first element 1. Cap 4 also extends as far as head 19 of second element 2. It further includes an added part 30, of which one portion 30' projects longitudinally. The upper portion of part 30 is welded to the lower face of cap 4. Projection 30' is engaged under shoulder 7' of body 7. Wings 29' and 29" (FIG. 4) each include a single transverse hole 31. In order to improve the rigidity of the assembly formed by first element 1 and cap 4, an elastic film can be inserted between shoulder 7' and projection 30' or the lower face of portion 29 of the cap. Moreover, the contact surfaces between the shoulder and the projection can advantageously be slightly inclined.

Strands 6 and 7 of the wristlet are formed of links 32 which are aligned longitudinally and whose ends have complementary shapes and are pierced by transverse holes 33 and 34.

Figure 1:
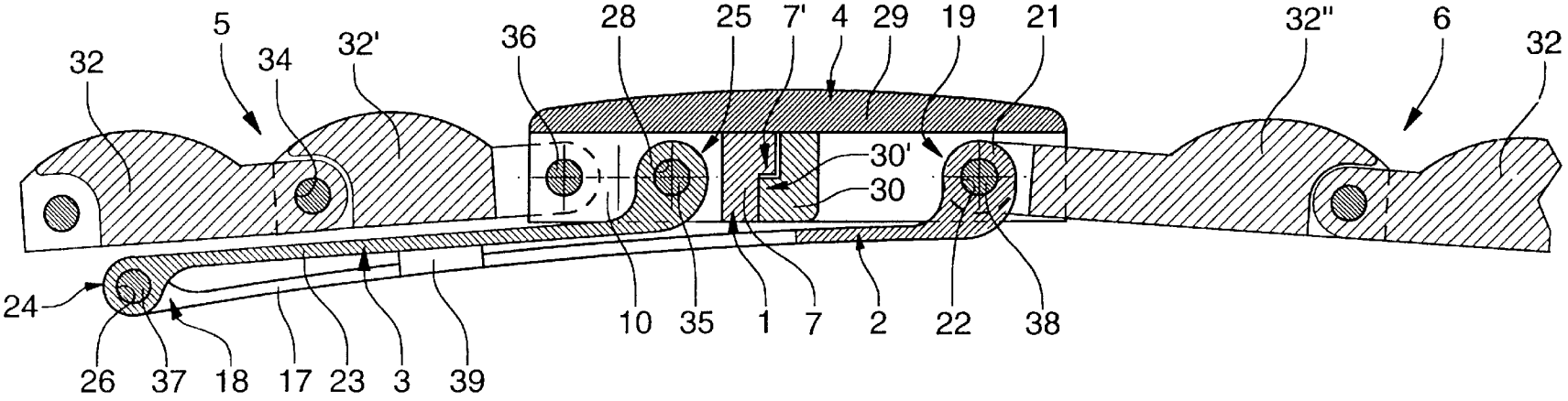
FIGS. 1 and 2 show, in cross-sectional views, a first embodiment of the invention in two configurations having structures adjusted respectively to two wristlet lengths, the clasp being closed.
Figure 3:
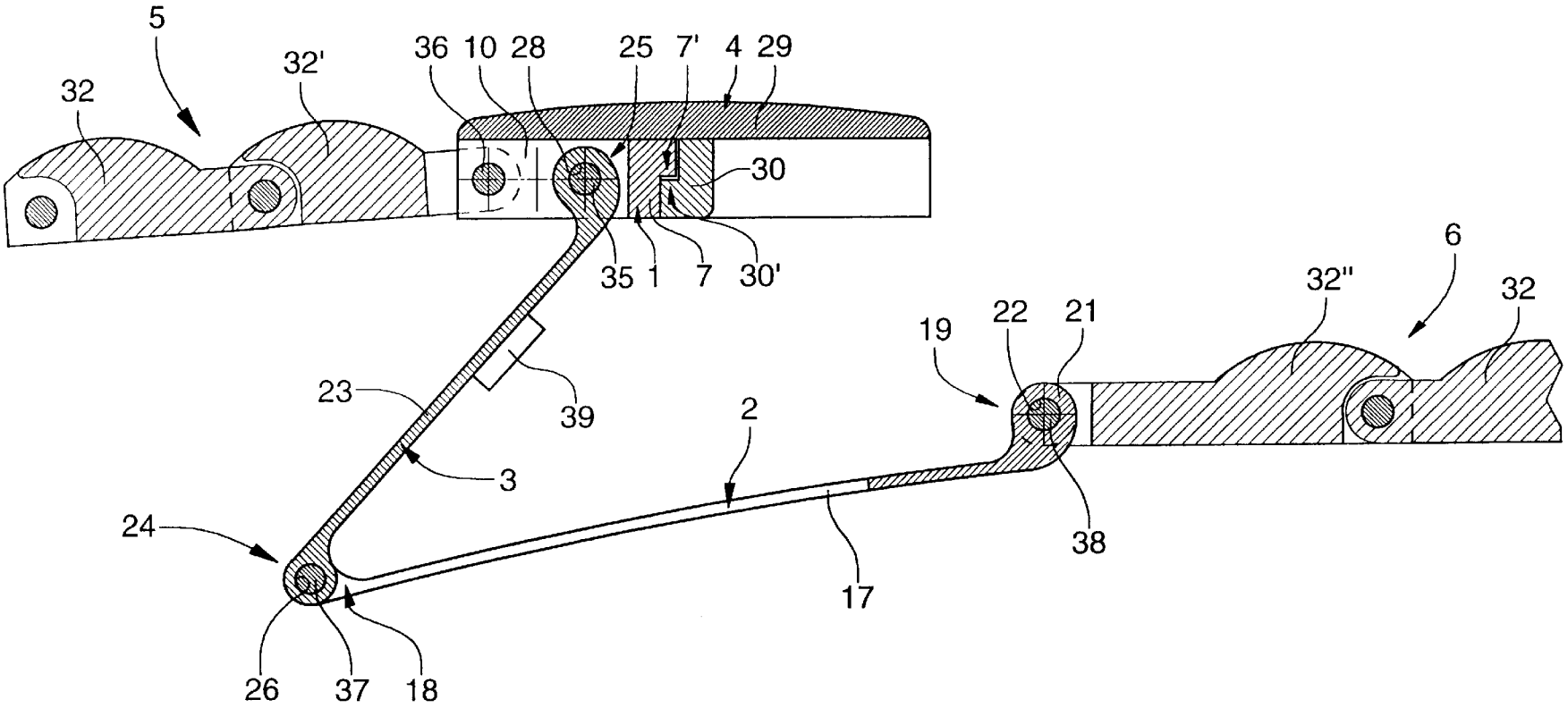
FIG. 3 shows the clasp according to the configuration of FIG. 1 in cross-section and in an open position.

The different parts of this clasp are assembled to each other by means of pins or screws. More precisely, first element 1 is connected to third element 3 by means of a screw 35 engaged in holes 16 and 28 of first and third elements 1 and 3. In the configuration of FIGS. 1, 3 and 4, the end link 32' of strand 5 is assembled in a hinged manner to first element 1 by a pin 36 engaged in holes 15 and 33' of first element 1 respectively of link 32'. This pin 36 penetrates also in holes 31 of cap 4. Pin 36 can advantageously be threaded at its end 36' (FIG. 4) and screwed into an internal screw head included in the inner wall of hole 33.

It will be noted that the walls of holes 15 and 16 of first element 1, and holes 28 and 33 of second element 2 respectively of link 32 all have a length greater than their diameter. Such a structure guarantees a solid and reliable mechanical connection to the clasp, without stressing the walls of hole 31 in each of the two wings 29' and 29".

Figure 2:
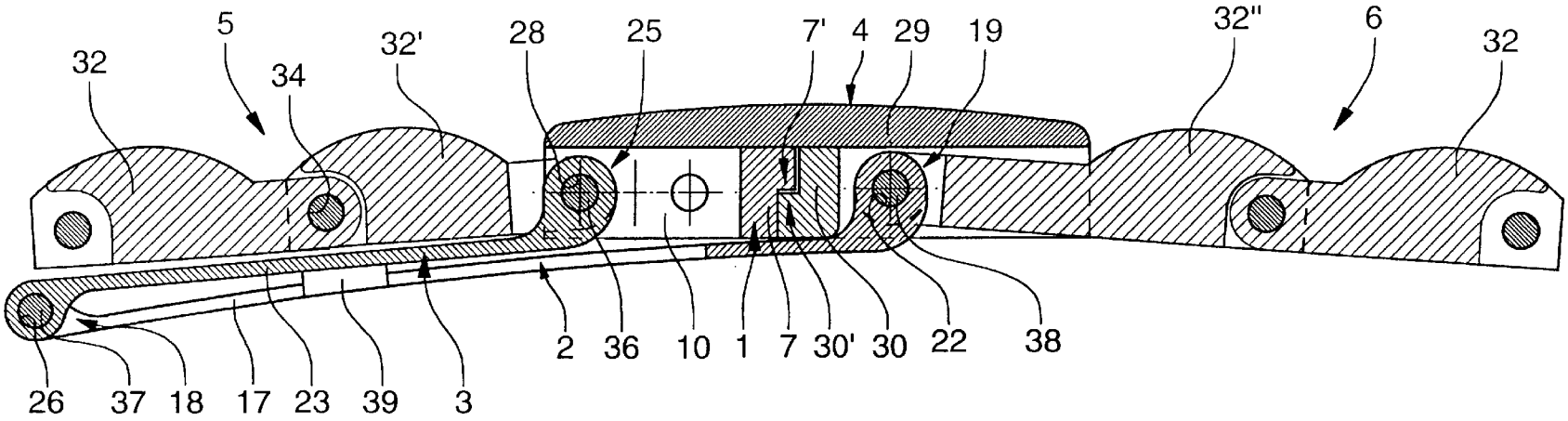

In the configuration shown in FIG. 2, both third element 3 and link 32' are mechanically connected in a hinged manner to first element 1 by pin 36, which is engaged in holes 15, 28 and 33' of first element 1, of third element 3 respectively of link 32'. In both the aforementioned configurations, third element 3 is mechanically connected in a hinged manner to second element 2 by means of a pin 37 which is permanently engaged in the holes of head 18 of element 2 respectively head 24 of element 3. Second element 2 is connected to end link 32" of link 6 by a pin 38 which is engaged in tube 21 of element 2 and in holes 33" of the ends of said neighboring link 32 " of the clasp.

It will be noted finally that the clasp is held closed by means of a snap fitting device between arms 17 and 23 of second and third elements 2 and 3, schematically shown and referenced 39 in FIGS. 1, 2 and 3. In FIG. 4, it can be seen that hole 16 is a blind hole in finger 8. However, in a variant, it is possible to make this hole a through hole on both sides of element 1 in which a pin is freely inserted. For the other pins, the usual solutions for fixing, by driving in, screwing or using spring type means, well known to those skilled in the art, are used.

As was explained hereinbefore, the clasp has a structure which allows the wristlet length to be adjusted, to fit it to the dimensions of the wearer's arm. In a first step, the length is set approximately, by removing or adding one or more links 32 to one and/or the other of strands 5 or 6. A finer adjustment is achieved by connecting third element 3 to first element 1 by screw 35 or pin 36. Since the distance between this pin and the screw is substantially equal to half the length of a link, it is thus possible to obtain an adjustment which is twice as precise as that which is achieved only with links.

It is of course understood that in the embodiment shown in FIGS. 1 to 4, it is possible to increase the length of fingers 8, 9 and 10, and to make more transverse holes, closer or further from each other, so as to further refine the adjustment of the wristlet length. Furthermore, it is obvious that the number of these fingers can be reduced or conversely increased without thereby departing from the scope of the invention. Moreover, various alternatives for the arrangement of said fingers of element 1 and the corresponding portions of element 3 of link 32' can be envisaged, in particular the omission of finger 9 and head 25 in a single part.

The embodiment illustrated in FIGS. 5 to 8, like that described with reference to FIGS. 1 to 4, includes three elements referenced 1 to 3. First element 1 is connected to one of the strands 5 of a wristlet, while second element 2 is connected to the other strand 6. Third element 3 connects the first and second elements in a hinged manner. This embodiment differs to that previously described in that the clasps has symmetry.

As the structure of second element 2 is the same as that of first element 1, the same parts bear the same references, with the letter <<a>> added for the parts associated with second element 2. The elements similar to the first embodiment will not all be described again here.

Figure 8:
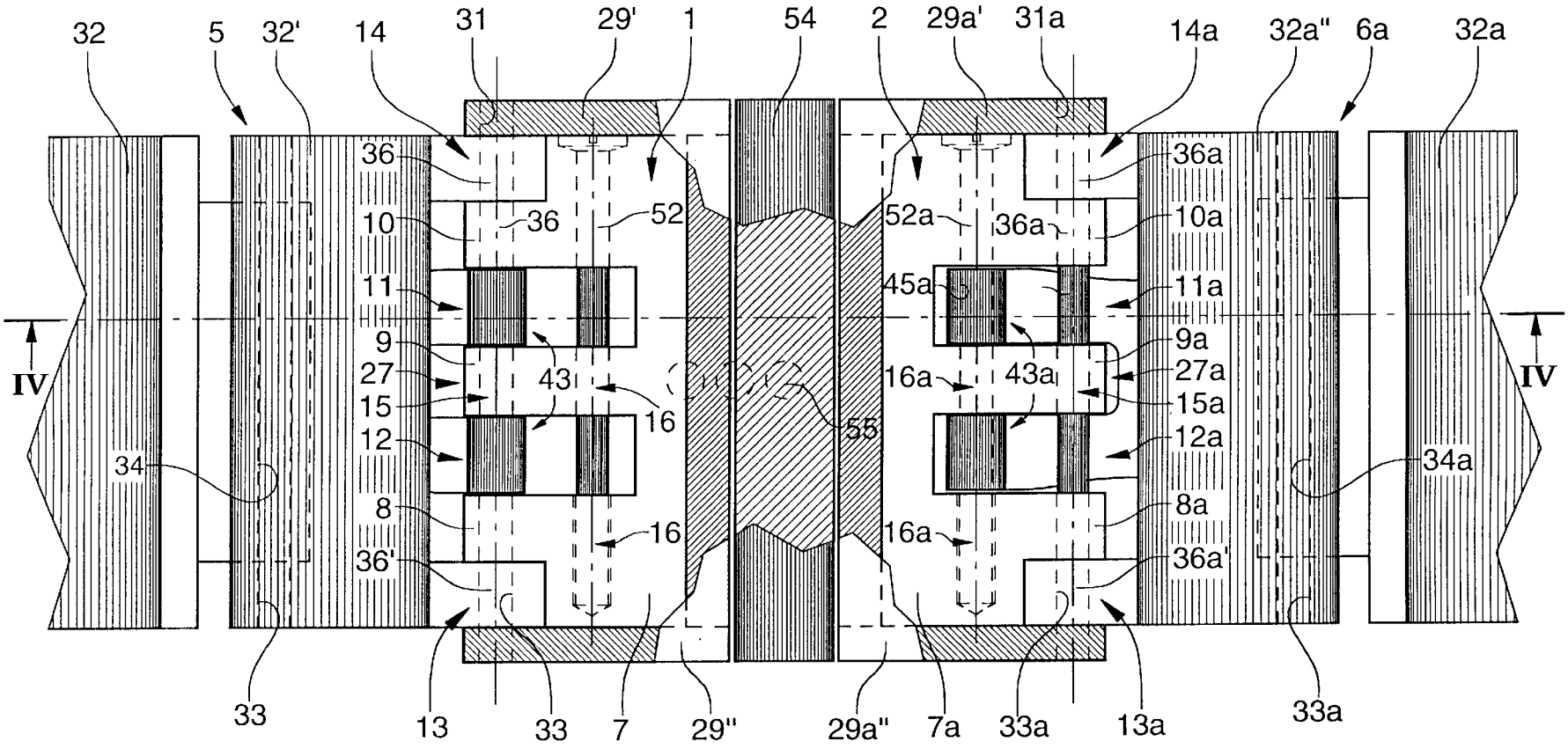
FIGS. 8 is a top plane view, partially torn away, of the clasp according to the configuration shown in FIG. 5.

Caps 4 and **4*a* each include a first portion 29 and 29*a* with a U shaped cross section whose median zone covers respectively first and second element 1 and 2 and whose wings 29', 29", 29*a*' and 29*a*" extend respectively on either side of first and second element 1 and 2 (FIG. 8). Caps 4 and 4*a* each further include a portion 30', 30*a*', provided with a portion 30', 30*a*' projecting longitudinally. Portions 30 and 30*a* are welded respectively to the lower face of caps 4 and 4*a* and respectively form a transverse lateral wall of said two caps. Projecting portions 30' and 30*a*' are respectively engaged under shoulders 7' and 7*a*' of bodies 7 and 7*a***.

Wings 29', 29" on the one hand, and **29*a*' and 29*a*" on the other hand, respectively include transverse holes 31 and 31*a* (FIG. 8**).

The structure of the wristlet is identical to that shown in FIGS. 1 to 4. This latter is also formed of links 32 aligned longitudinally and whose ends have complementary shapes and are pierced by transverse holes 33 and 34.

Third element 3, which connects first and second elements 1 and 2, includes three hinged parts bearing the references 40, **40*a* and 41. Parts 40 and 40*a* are identical. They include in their central part an arm bearing the reference 42 and 42*a* and, at each end of the arm, a head 43 and 44, 43*a* and 44*a* respectively. Heads 43 and 44, 43*a* and 44*a* are each pierced by a hole respectively referenced 45, 46, 45*a* and 46*a*. Part 41 has the same structure, with an arm 47 and two heads 48 and 49** which are also pierced by holes.

In a similar manner to the clasp according to the first embodiment, the parts are assembled to each other in pairs in a hinged manner, by means of pins or screws. Thus parts 40 and **40*a* are respectively connected to elements 1 and 2 by means of screws 52 and 52*a* or pins 36 and 36*a* engaged in holes 45 and 45*a* of parts 40 and 40*a* and in one or other of holes 15 and 16, 15*a* and 16*a* respectively of elements 1 and 2. Parts 40 and 40*a* are respectively connected to part 41 by means of pins 53 and 53*a* which are engaged in holes 46 and 46*a* of parts 40 and 40*a* and in the holes made in heads 48 and 49 of part 41**.

The clasp also includes catch locking means achieved by the mutual engagement of one portion of arms 42 and **42*a* with a portion of arm 47, schematically shown and referenced 39 and 39*a***.

Figure 5:
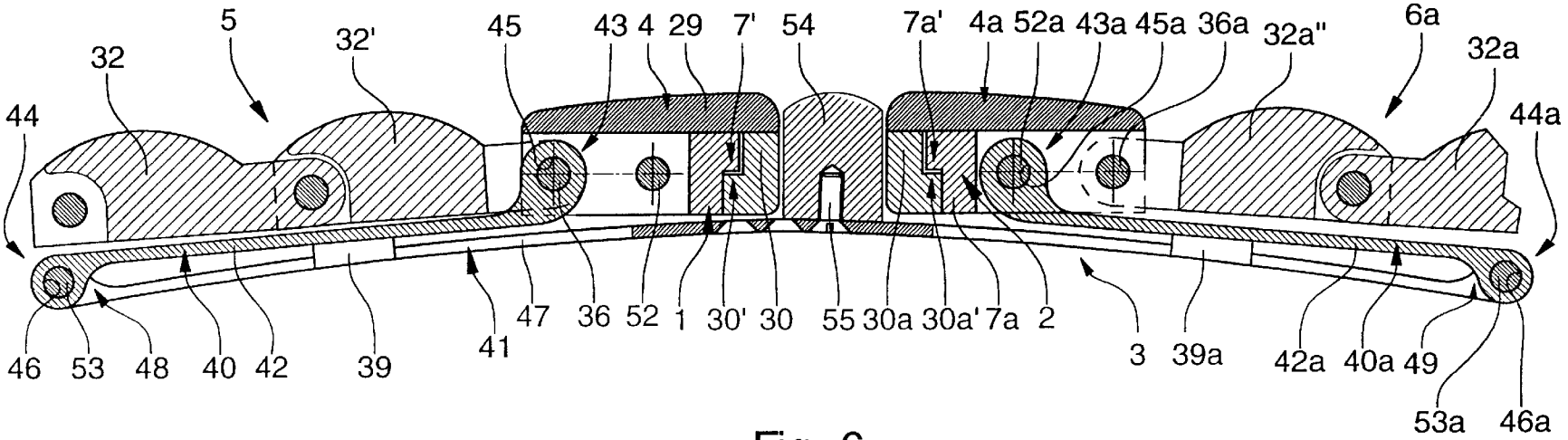
FIGS. 5 and 6 illustrate a second embodiment, shown in cross-section, the two configurations respectively having structures adjusted to two wristlet lengths, and the clasp being closed.
Figure 6:
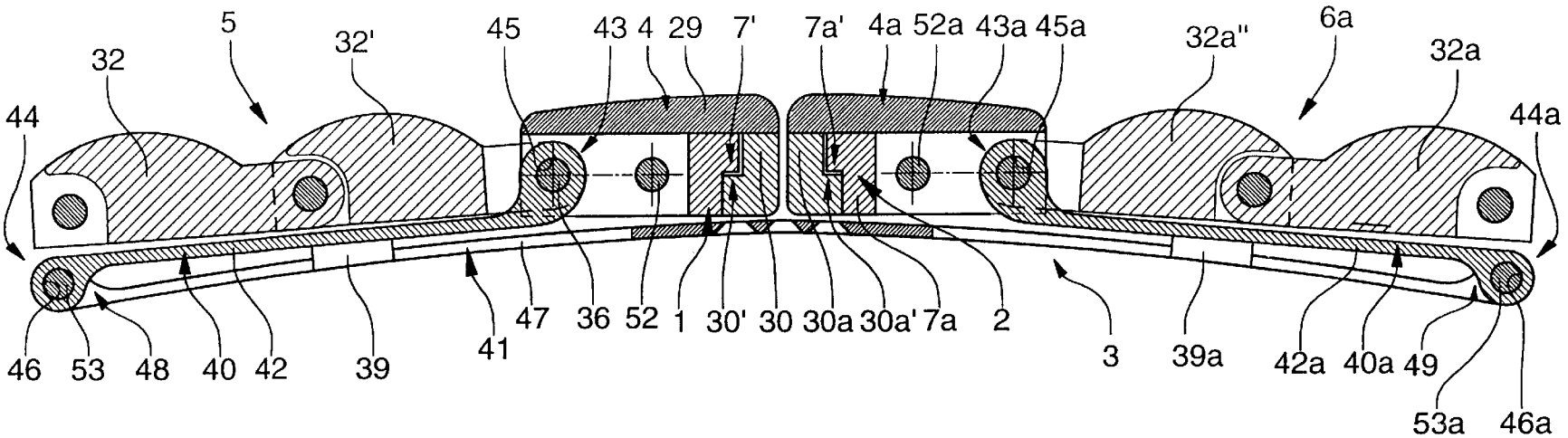
Figure 7:
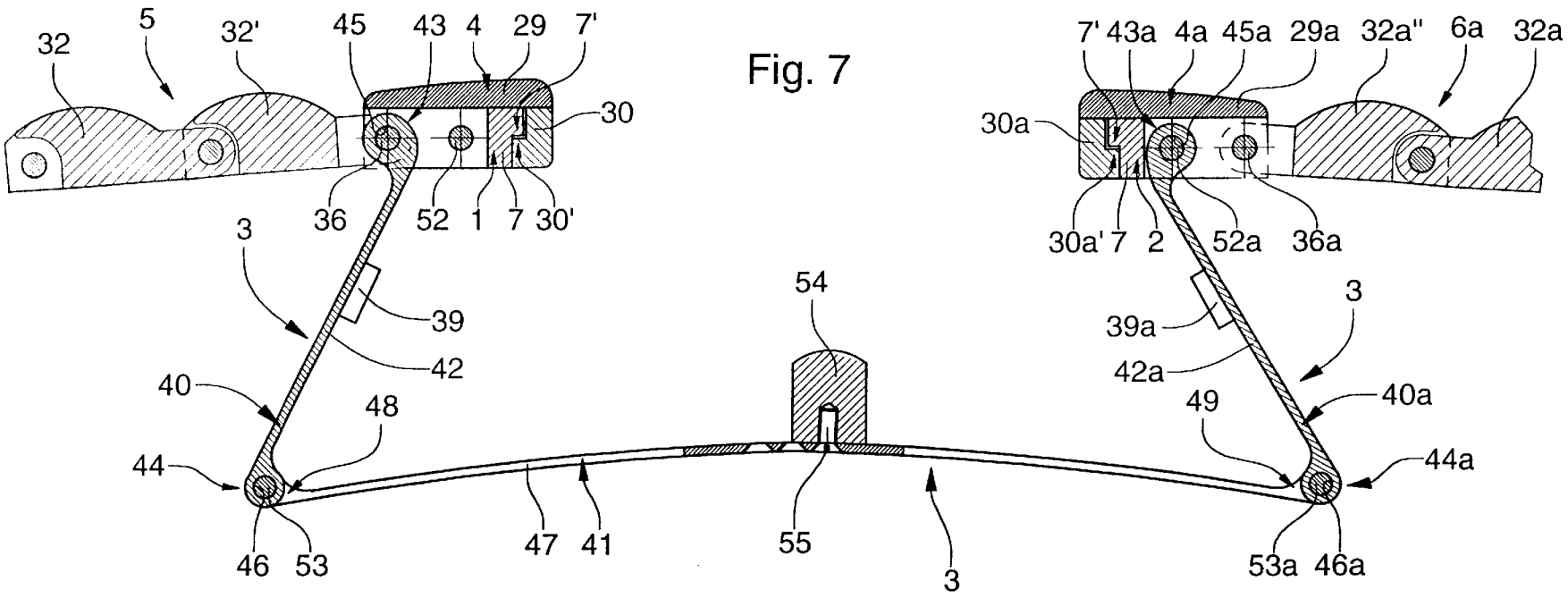
FIG. 7 shows the clasp of the configuration shown in FIG. 5 in cross-section and in an open position.

Thus, as can be seen by comparing the configurations of FIGS. 5 and 6, the transverse lateral faces of caps 4 and **4*a* which may or may not define a space between them, according to whether the third element is engaged in pins 36, 36*a* or screws 52, 52*a*. It is possible to fill this space by adding an additional part 54, removably fixed by means, in particular, of a screw 55 onto part 41 of third element 3**.

It will be noted that since the two elements 1 and 2 here allow adjustment of the length of the closed wristlet, one can adjust to a precision of ⅓ and ⅔ the length of a link. In FIG. 5, the length is increased by a third of a link relative to the configuration of FIG. 6, while this increase is two thirds of a link in FIG. 9.

Figure 9:
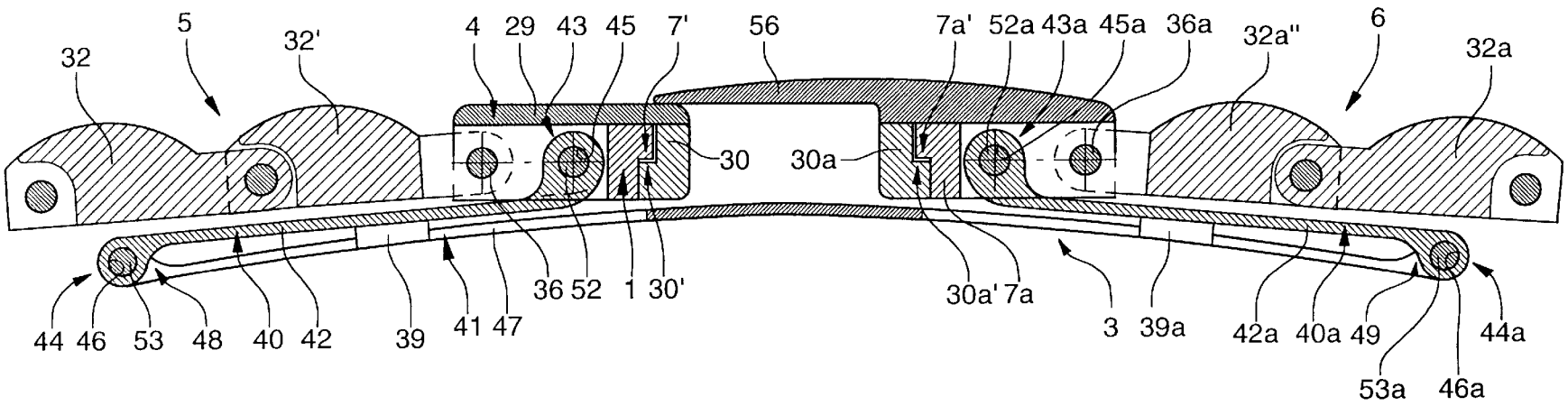
FIG. 9 shows a variant of the clasp of FIGS. 5 to 8.

FIG. 9 is an alternative embodiment wherein cap **4*a* includes a visor 56 covering cap 4** at least partially, in both adjusting positions. This solution allows the use of an additional part to be avoided, while keeping the advantage of a fine adjustment of the length of the wristlet. In another alternative, not shown, different caps could be used according to the wristlet length adjustment position.

Clasps such as that described hereinbefore allow the drawbacks of the claps according to the prior art to be considerably reduced. More precisely, the hole made in the wings of the cap no longer form part of the chain formed by the clasp, the wristlet strands and the watch. Consequently, when the watch is fastened, the stresses are applied only onto the walls of the holes made in solid parts. Wear is thereby considerably reduced.

Moreover, the cap is rigidly fixed to the adjusting element, longitudinally on one side by engagement of a projecting part under a shoulder, on the other by a pin and transversally by the wings of the cap. Consequently, opening and closing of the clasp can be performed securely. It will be noted that during this operation, the pin which fixes the first element to the cap is not subjected to much stress.

The wings of the cap improve the aesthetic appearance of the wristlet by hiding the additional holes intended to assure the setting of the wristlet's length.

Finally, it is clear that the invention is not limited to link wristlets, but can also be applied to other types of wristlet and in particular to wristlets having strands at least partially made of leather or of soft materials.

What is claimed is:

1. A wristlet clasp including a first and a second element intended to be connected respectively to a first strand and to a second strand of a wristlet, a third element which mechanically connects the first and second elements in a hinged manner, and means for adjusting the length of said wristlet so as to fit it to a wearer's arm and which include at least one pin or removable screw engaged in a transverse adjusting hole of a plurality of transverse adjusting holes which are parallel to each other and made in said first element, said pin or screw also being engaged in a transverse hole made in said third element, wherein the adjustment of the length of said wristlet is effected by a variation of the position of this third element relative to said first element, wherein said first strand is attached to said first element at a fixed position, this first element having at least a notch or a step at a first end side for the introduction of an end portion of said first strand, and wherein this clasp further includes a cap removably fixed to said first element and which includes two lateral portions covering at least one transverse adjusting hole of said plurality of transverse adjusting holes.

2. A clasp according to claim 1, wherein said first element includes two pins or screws respectively engaged in two of said transverse adjusting holes of said first element and one of which connects the first element to said first strand of the wristlet, and wherein said third element is connected to the first element by one or other of the two pins or screws.

3. A clasp according to claim 2, wherein said cap includes a transverse hole aligned on one of said two transverse adjusting holes and in which one of the two pins or screws is engaged, which thus further assures the fixing of said cap to said first element.

4. A clasp according to claim 3, wherein said transverse adjusting hole of said cap is made in the two lateral portions of said cap, said two lateral portions covering the whole of said plurality of transverse adjusting holes made in said first element with the exception of the transverse hole provided for said pin which assures the fixing of the cap to the first element.

5. A clasp according to claim 4, wherein said first element includes, on a second end side opposite to said first end side, a shoulder oriented transversally, and wherein said cap includes a part comprising a projecting portion, engaged under said shoulder for assuring the rigid assembly of the cap to said first element together with said pin which assures the fixing of the cap to the first element and with said lateral parts of said cap.

6. A clasp according to claim 5, wherein said first element has a solid structure and has at least a notch or a recess for the introduction of a portion of said third element.

7. A clasp according to claim 6, wherein the length of each hole included in the first element is at least equal to the diameter of the hole.

8. A clasp according to claim 1, wherein said first element has a solid structure and has at least a notch or a recess for the introduction of an end portion of said third element.

9. A clasp according to claim 8, wherein the length of each hole included in the first element is at least equal to the diameter of the hole.

10. A clasp according to claim 1, wherein the second element also includes means for adjusting the length of said wristlet which include a removable pin, engaged in a transverse adjusting hole of a plurality of transverse adjusting holes made in said second element and in a second transverse hole of the third element, and wherein said clasp further Includes a second cap removably fixed to said second element and comprising two lateral portions covering at least one of said transverse adjusting holes of said second element.

* * * * *